United States Patent [19]

Nakamura et al.

[11] Patent Number: 4,913,737

[45] Date of Patent: Apr. 3, 1990

[54] SINTERED METALLIC PARTS USING EXTRUSION PROCESS

[75] Inventors: Hideki Nakamura, Yonago; Takayuki Fukaya, Yasugi, both of Japan

[73] Assignee: Hitachi Metals, Ltd., Tokyo, Japan

[21] Appl. No.: 211,269

[22] Filed: Jun. 3, 1988

Related U.S. Application Data

[60] Division of Ser. No. 57,636, Jun. 4, 1987, Pat. No. 4,769,212, which is a continuation of Ser. No. 844,567, Mar. 27, 1986, abandoned.

[30] Foreign Application Priority Data

Mar. 29, 1985 [JP] Japan ..... 60-65540
Jul. 30, 1985 [JP] Japan ..... 60-168160
Jul. 30, 1985 [JP] Japan ..... 60-168161

[51] Int. Cl.[4] ..... C22C 39/02

[52] U.S. Cl. ..... 75/228; 419/10; 419/7; 419/23; 419/36; 419/38; 419/41; 419/55; 419/56; 419/65; 419/67; 408/119; 408/204; 408/205; 408/206; 76/108 T

[58] Field of Search ..... 419/7, 10, 23, 38, 36, 419/41, 55, 56, 65, 67; 408/119, 204, 205, 206; 76/108; 75/228

[56] References Cited

U.S. PATENT DOCUMENTS 4,813,823 3/1989 Bieneck ..... 408/59

OTHER PUBLICATIONS

R. L. Sand et al., Powder Metallurg Practice and Applications, 1966, pp. 71–72.

*Primary Examiner*—Brooks H. Hunt
*Assistant Examiner*—Ngoclan T. Mai
*Attorney, Agent, or Firm*—Finnegan, Henderson, Farabow, Garrett & Dunner

[57] ABSTRACT

Metallic sintered parts with hollow structure and high density and toughness can be produced easily be kneading a raw metallic powder with an aqueous solution of an organic binder, extruding the resulting kneaded mixture, removing the organic binder from the extruded product and sintering the binder removed extruded product.

18 Claims, No Drawings

SINTERED METALLIC PARTS USING EXTRUSION PROCESS

This is a division of application Ser. No. 057,636 now U.S. Pat. No. 4,769,212, filed June 4, 1987 which was a continuation of Ser. No. 844,567 filed Mar. 27, 1986, now abandoned.

BACKGROUND OF THE INVENTION

This invention relates to a process for producing metallic sintered parts such as those having one or more holes penetrating along the longer direction, rod-like metallic sintered parts, e.g., round rods, shapes having different forms of cross-section, wires, etc., and thin-plate-like metallic sintered parts.

In the field of stocks such as metallic materials, plastics, rubbers, ceramics, etc., there are generally present hollow rod-like or thin-plate-like products (hereinafter referred to as "hollow material"). In the field of metallic materials to which this invention relates, hollow materials are produced by various processes such as cutting, hot extrusion, drawing, welding, etc. On the other hand, as to plastics, rubbers, ceramics, hollow materials are produced by mixing and kneading a raw material with a binder and extruding from a die while in a plastic state. But as to metallic materials, the production of hollow materials by the extrusion using a powder as a starting material like ceramics and plastics is hardly applied. This is because there have not been developed a technique for producing a starting material powder suitable for the extrusion, the selection of an organic binder used therefor and a densifying or consolidating method after the extrusion.

As to the organic binder, it is required to have a high viscosity in a small amount, to give a molded article having high strength and to show a uniform degree of dispersion. Further, it is also necessary that the removal of the organic binder after the molding is easy and harmful decomposition products are not retained. There have been proposed various thermoplastic or thermosetting resins as a binder useful for the extrusion. For example, Japanese Patent Unexamined Publication No. 113511/80 discloses the use of polyethylene, polystyrene, or acrylonitrile-butadiene-styrene copolymer together with a silane coupling agent or titanium coupling agent; Japanese Patent Unexamined Publication No. 113510/80 discloses a process for molding a ceramic powder or a metallic powder by injection or extrusion using a silane cross-linked type polyalkene resin; and Japanese Patent Unexamined Publication No. 159248/81 discloses the use of polytetramethylenephthalate as a binder. These binders are mainly organic resins, but their removal after the molding is very difficult, because, e.g., in the case of products having a thickness of about 10 mm, the temperature rising rate for the removal should be 5° to 10° C./hr or less in order to prevent the products from foaming and loss of their shapes.

SUMMARY OF THE INVENTION

It is an object of this invention to provide a process for producing a metallic sintered part overcoming the problems mentioned above.

This invention providesa process for producing a metallic sintered part which comprises mixing and kneading a raw metallic powder having a particle size of 50 μm or less with a binder composition to give a plastic mixture having 1.0 to 15.0% by weight of the solid content of the binder composition based on the weight of the raw metallic powder, extruding the plastic mixture to give an extruded product, removing the binder composition from the extruded product with heating in vacuum or in a non-oxidizing atmosphere, and sintering the resulting product for consolidation.

DESCRIPTION OF THE PREFERRED EMBODIMENTS

As the raw metallic powder, there can be used an alloy powder having substantially the same composition as a desired final product, or a mixture of a plurality of metallic powders having the same constituting elements as the desired final product.

Examples of the alloy powder are an iron-base alloy powder for high speed tool steel comprising 0.4 to 4.5% by weight of C, 30% by weight or less of Cr, 3% by weight or less of Ni, 1.0 to 30.0% by weight of W+2Mo, 20% by weight or less of Co, 20% by weight or less of V, 2% by weight or less of deoxidating agent such as Si, Mn, or the like, the balance being Fe, and trace amounts of impurities inherently present. The iron-base alloy powder may further contain 3.0 to 20.0% by weight, based on the weight of the iron-base alloy powder, of at least one nitride and/or carbide selected from the group consisting of VN, TiN, NbN, ZrN, VC, TiC, NbC and ZrC.

Examples of the mixture of a plurality of metallic powders are a mixture of iron powder and silicon powder, e.g. carbonyl iron powder containing 3% by weight of pure silicon powder, etc.

It is also possible to use iron powder containing 0.3% by weight or less of C and trace amounts of impurities inherently present; Fe-Ni series Permalloy powders containing 0.3% by weight or less of C, 22 to 85% by weight of Ni, 5.0% by weight or less of at least one of W, Mo, Cr, V, Nb, Si and Mn, and balance being Fe and impurities inherently present; alloy powders containing 0.4–4.5% by weight of C, 10 to 40% by weight of Cr, 10% by weight or less of Ni, 2.0 to 20.0% by weight of W+2Mo, 20% by weight or less of V and balance being Co and impurities inherently present, etc.

The raw metallic powder should have an average particle size of 50 μm or less in order to ensure uniform dispersion of the powder at the time of kneading, to ensure the strength of molded products and to increase a sintering density. Preferable average particle size is in a range of 5 to 20 μm. When the particle size is too fine, there is a tendency to make it difficult to remove the organic binder. The raw metallic powder preferably has a shape so as to make a packing density as high as possible. Thus, the raw metallic powder preferably has an apparent density of 30% or more of the true density. The raw metallic powder preferably has a tap density of 40% or more.

The raw metallic powder having a particle size of 50 μm or less can be prepared by a conventional method such as pulverization using an attritor after atomizing a molten metal by water or a gas.

For example, the raw metallic powder can be obtained by a water atomizing method, followed by a mechanical pulverizing method without subjecting to a heat treatment such as reduction, annealing, etc. to give a powder having an average particle size of 50 μm or less and a tap density of 40% or more.

The binder composition used in this invention comprises at least one water-soluble organic binder and a solvent. That the organic binder is water-soluble is effective to improve the removal rate of binder and to prevent the generation of defects at the time of removing the binder.

Examples of the water-soluble organic binder are methylcellulose, polyvinyl alcohol, hydroxypropyl methylcellulose, hydroxymethylcellulose, polyethylene glycol, etc. Among them, methylcellulose (MC) and hydroxymethylcellulose (HMC) are preferable.

One or more water-soluble organic binders are used preferably in an amount of 1.0 to 15.0% by weight, more preferably 1.0 to 10.0% by weight, based on the weight of the raw metallic powder. Particularly, the use of 1.0 to 5.0% by weight of methylcellulose and/or hydroxymethylcellulose is preferable to remarkably reduce the production of defects in molded articles. Further, among various methylcelluloses, those which are not subjected to thermal gelation are effective to prevent cracks at the time of molding.

The binder composition may further contain one or more molding auxiliary agents such as plasticizers, dispersing agents and lubricants to impart plasticizing, dispersing, lubricating and mold releasing properties. Examples of the molding auxiliary agents are polyhydric alcohols and esters or ethers thereof, propylene glycol, polyethylene oxide, water-soluble acrylic resins, wax emulsions, crystalline celluloses, stearic acid emulsion, microcrystalline wax. These may be used alone or as a mixture thereof in an amount of preferably 7% by weight or less based on the weight of the raw metallic powder. As the polyhydric alcohol, the use of glycerin is more preferable.

A total amount of the water-soluble organic binder, the plasticizer and/or dispersing agent and/or labricant is preferably 1.0 to 15.0% by weight based on the weight of the raw metallic powder.

Water is used as the solvent in an amount of preferably 4.0 to 15.0% by weight, more preferably 4.0 to 9.0% by weight, based on the weight of the raw metallic powder so as to maintain enough strength of the product and to prevent the generation of defects in the product.

Preferable examples of the binder compositions are as follows: a binder composition comprising 1.0 to 5.0% by weight of methylcellulose substantially showing no thermal gelation as a water-soluble organic binder, 2.0% by weight or less of glycerin, 5% by weight or less of at least one member selected from the group consisting of a wax emulsion, a stearic acid emulsion and microcrystalline wax, as molding auxiliary agents, and 4.0 to 15.0% by weight of water, all the weight percents being based on the weight of the raw metallic powder; a binder composition comprising 1.0 to 5.0% by weight of hydroxymethylcellulose as a water-soluble organic binder, 2% by weight or less of glycerin, 5% by weight or less of at least one member selected from the group consisting of a wax emulsion, a stearic acid emulsion and microcrystalline wax as a molding auxiliary agent, and 4.0 to 15.0% by weight of water, all the weight percents being based on the weight of the raw metallic powder, etc.

The raw metallic powder and the binder composition are mixed and kneaded by a conventional method, for example, using a kneader, a Henschel mixer, etc.

The resulting kneaded plastic mixture is extruded by a conventional method to give an extruded product.

The extruded product is subjected to removal of the binder composition with heating preferably at 300° to 700° C. in vacuum or in a non-oxidizing atmosphere such as in a reducing gas, e.g., hydrogen or the like, or in an inert gas, e.g., argon, helium, nitrogen, or the like. The water which is a solvent in the binder composition is almost removed during drying after the extrusion. When the removal of the binder composition is carried out in vacuum or in an atmosphere of Ar, $N_2$, He or the like, about 0.3 to 0.8% by weight of carbon is retained as a decomposition product. When the removal of the binder composition is carried out in an atmosphere of hydrogen, almost no carbon is retained as a decomposition product of the binder composition. Therefore, when a product requires no retention of carbon, it is necessary to remove the binder composition in an atmosphere of hydrogen. It is also possible to reduce the amount of carbon in the raw metallic powder previously considering the amount of carbon to be retained, but in order to control the carbon amount with high precision, it is preferable to remove the binder composition in an atmosphere of hydrogen.

After the removal of the binder composition, the extruded product is subjected to sintering for consolidation at a temperature of 1100° C. to 1350° C. After the sintering, the resulting product has a density of preferably 95% or more, more preferably 97% or more of the true density.

After the sintering, the resulting product may further be subjected to plastic working such as forging, rolling, drawing, swaging, etc. or to hot hydrostatic working to give metallic sintered parts having the desired high density and desired final shape.

According to the present invention, there can be obtained metallic sintered parts having one or more holes penetrating along the longer direction, rod-like metallic sintered parts, thin-plate-like metallic sintered parts, from high speed tool steel, stainless steel, soft-magnetic material, structural steel, and the like.

The metallic sintered parts having one or more holes penetrating along the longer direction can be made of high speed tool steel and can be used for a hollow punch or a drill with oil holes. Further, the metallic sintered parts obtained from high speed tool steel can have different forms at cross-sectional shapes and the same form along the longer direction.

For example, a metallic sintered part having one or more holes penetrating along the longer direction, made of high speed tool steel, used for a drill with oil holes, and having a density of 97% or more of the true density, can be produced, after the sintering, by twisting corresponding to a lead angle of the drill under cold, warm, or hot working conditions.

It is also possible to produce a metallic sintered part having one or more holes penetrating along the longer direction, made of high speed tool steel, used for a hollow punch or a drill with oil holes, by further subjecting to, after the sintering, working comprising inserting a wire difficult to stick to the high speed tool steel or a wire coated with a ceramic powder into one or more hollow portions at the state of maintaining the density of 97% or more of the true density after sintering, conducting drawing or swaging for narrowing diameters of the holes, and removing the wire.

This invention is illustrated by way of the following Examples, in which all percents are by weight unless otherwise specified.

EXAMPLE 1

A water atomized preliminary alloy powder comprising C 1.51%, Si 0.41%, Mn 0.2%, Cr 4.03%, W 11.05%, Mo 0.8%, V 5.1%, Co 5.2%, balance Fe and impurities inherently present corresponding to AISI (American Iron and Steel Institute) steel grade T15 was prepared. The average particle size was 45 μm and $O_2$ content was 1800 ppm. A part of the alloy powder was taken out and 0.3% of graphite powder was added thereto, followed by dry mixing and pulverization in an attritor to make the average particle size 15 μm.

To the resulting powder, 3% of methylcellulose (SM 400, commercially available from Shin-etsu Chemical Industry Co., Ltd.), 8% of water, 2.0% of microcrystalline wax, 1% of a stearic acid emulsion, and 0.7% of glycerin, based on the weight of the alloy powder, were added and kneaded for 15 minutes in a kneader. The kneaded mixture was extruded by using an extruder having an auger cylinder diameter of 50 mm to mold a hollow tube having an outer diameter of 10 mm and an inner diameter of 4 mm. The extruded product having a green density of 51% of the true density at the time of extrusion was dried at 50° C. for 2 hours under a weak vacuum. The dried product was then subjected to removal of the binder components either in an atmosphere of hydrogen or in vacuum of 0.1 Torr or in an atmosphere of argon while heating with a temperature rise rate of 100° C./hr up to 500° C., at which temperature the product was maintained for 2 hours. Then, each product was sintered at 1180° to 1240° C. under vacuum of $10^{-3}$ Torr.

The products subjected to binder removal in vacuum or in an atmosphere of argon reached the true density at a sintering temperature of 1180° C., in which state the carbon content was 2.2% and the oxygen content was 40 ppm.

On the other hand, the product subjected to binder removal in an atmosphere of hydrogen reached the true density at 1240° C., in which state the carbon content was 1.51% and the oxygen content was 60 ppm.

The carbon contents in the removed binder after the removal of binder were 2.60% in the case of the binder removal in vacuum, 2.54% in the case of the binder removal in argon, and 1.81% in the case of the binder removal in hydrogen.

As is clear from the above results, the sintered product subjected to the binder removal in hydrogen shows substantially no residual carbon from the binder, while sintered products subjected to the binder removal in vacuum and in argon show about 0.7% of residual carbon from the binder.

Shrinkage after sintering was 21.6% at the outer diameter and 22.1% at the inner diameter. The resulting hollow material was almost a true round.

As to the shrinkage, since the true density was attained in all the cases, no significant difference was admitted in the atmospheres for the binder removal.

For comparison, a knead mixture was prepared by kneading a water atomized powder of 100 mesh usually used for sintering and having the same composition as mentioned abaove with the same binder components as mentioned above. The kneaded mixture showed almost no viscosity. When water was added in an amount of 15% based on the weight of the alloy powder, no improvement was admitted. Then, the amount of methylcellulose was increased to 6% and the amount of microcrystalline wax was increased to 4.0% to prepare a kneaded mixture. The resulting kneaded mixture showed a viscosity necessary for the extrusion, but the extruded product lost its shape partly after the binder removal, and thus the handling of the extruded product was practically impossible.

EXAMPLE 2

To the same powder after pulverization in an attritor as used in Example 1, 0.3% of C was added similarly. Then 5% of methyl cellulose (60 SH-4000, commercially available from Shin-etsu Chemical Industry Co., Ltd.), 6.5% of glycerin and 8% of water were added thereto, followed by kneading in a kneader for 15 minutes.

A round rod having an outer diameter of 10 mm was produced as described in Example 1. Then, the round rod was subjected to the binder removal in hydrogen and sintered at 1240° C. for 1 hour.

The sintered product had a density of 8.21 g/cm$^3$ which value is very close to the true density, a carbon content of 1.52% and oxygen content of 72 ppm.

EXAMPLE 3

A water atomized preliminary alloy powder comprising C 0.89%, Si 0.32%, Mn 0.28%, Cr 3.97%, W 5.98%, Mo 5.12%, V 1.92%, balance Fe and impurities inherently present was prepared. The oxygen content in the alloy powder was 1700 ppm. After adding 0.3% of carbon to the alloy powder, the resulting mixture was pulverized in an attritor to give a fine powder having an average particle size of 12 μm. To the resulting powder, 2% of methylcellulose (60 SH-4000), 1% of glycerin and 8% of water were added and kneaded in a Henschel mixer. The resulting kneaded mixture was extruded to give an extruded product having an outer diameter of 12.8 mm with 2 holes each having a hole diameter of 1.8 mm, the distance between the two centers of holes being 7.28 mm, penetrating along the longer direction. Then, the extruded product was dried at 50° C. for 2 hours under a weak vacuum, followed by heating at a temperature rise rate of 150° C./hr in hydrogen upto 700° C., at which temperature the extruded product was maintained for 1 hour. After cooling, sintering in vacuum was conducted at 1235° C. for 15 hours. The resulting sintered hollow material had a density of almost 100% of the true density, the outer diameter of 10.2 mm, the hole diameter of 1.33 mm in individual two holes, and the distance between the two centers of holes of 5.5 mm.

The sintered hollow material was subjected to drawing working until the outer diameter became 5 mm. The working was continued with an area reduction rate of 20% and by inserting an intermediate annealing procedure.

As a result, a hollow material having an outer diameter of 5.0 mm, a hole diameter of individual holes of 0.65 mm, and a distance between the two centers of holes of 2.7 mm was produced as a final product without causing any damage during the working.

On the other hand, when a standard heat treatment for this material of double tempering for 1 hour at 560° C. subsequent to quenching at 1200° C. was applied to the hollow material, the resulting product had a hardness of HRC 65.4 and bending strength of 370 kg/mm$^2$. These values are almost the same as obtained in the material produced by a conventional melting process.

EXAMPLE 4

To carbonyl iron powder having an average particle size of 6 μm, 3% of pure silicon powder having a particle size of 7 μm was added. Then, 2.1% of methylcellulose, 2.5% of glycerin and 7.5% of water were added and kneaded in a kneader for 30 minutes. The kneaded mixture was extruded by using the same die as used in Example 1. After drying under a weak vacuum, the extruded product was heated to 500° C. at a temperature rise rate of 200° C./hr in hydrogen atmosphere and maintained at 500° C. for 1 hour. After cooling, the thus treated extruded product was sintered at 1450° C. for 1 hour in vacuum.

The resulting product had a density of 96.1% of the true density, a carbon content of 0.3% and oxygen content of 3400 ppm.

Then, the product was subjected to magnetic annealing in $H_2$ at 1000° C. for 1 hour. The carbon content was lowered to 0.02%. There were obtained magnetic properties of coercive force (Hc) 0.4 oersted, residual induction (Brr) 11100 Gauss, and maximum permeability ($\mu_{max}$) 13430.

EXAMPLE 5

A water atomized preliminary alloy powder comprising C 3.1%, Cr 4.5%, W 10.2%, Mo 8.6%, V 7.0%, Co 8.4%, balance Fe and impurities inherently present having an average particle size of 56 μm was prepared. After mixing the resulting powder with 0.4% of graphite powder, 10% of TiN and 1.0% of VC powder, the resulting mixture was pulverized by using a dry-type attritor in an argon gas stream. The average particle size after pulverization was 12.4 μm. To the resulting mixture, 3.0% of hydroxymethylcellulose, 1.0% of glycerin, 0.5% of polyvinyl alcohol, 0.7% of wax emulsion, 0.4% of microcrystalline wax and 5.0% of water were added and kneaded in a kneader. The kneaded mixture was extruded in the form of fine linear rod having an outer diameter of 2.5 mm at an extrusion pressure of 4.0 kg/cm$^2$. The extruded product was heated to 500° C. at a rising rate of 100° C./hr and subjected to removal of binder at that temperature in vacuum of $10^{-1}$ Torr. Then, the temperature was raised to 1240° C. at a rate of 300° C./hr and the degree of vacuum was increased to $10^{-3}$ Torr to conduct the sintering. The density after sintering was 7.7 g/cm$^3$ and regarded as substantially the true density due to no residual holes. After thrice tempering at 550° C. for 1 hour subsequent to quenching at 1230° C., the resulting product had the hardness of HRC 73.5 and the flexural strength of 190 kg/mm$^2$.

From this material, a drill having a small diameter of 1.4 mm was made and a cutting test was conducted using AISI 6150 ($H_B$ 250) as a material to be cut. As a result, drilling of 450 holes was possible.

For comparison, when a drill made of AISI M2 was used, drilling of only 20 holes was possible.

EXAMPLE 6

A water atomized preliminary alloy powder comprising C 2.6%, Cr 31.5%, W 12.0%, V 1.0%, balance Co and impurities inherently present having an average particle size of 64 μm was prepared. After pulverizing in the same manner as described in Example 5, a powder having an average particle size of 18.0 [m was obtained. To this powder, 2.5% of methylcellulose having a molecular weight of 400, 1.2% of glycerin, 0.7% of microcrystalline wax, and 6.0% of water were added and kneaded. After removing the binder in the same manner as described in Example 5, sintering in vacuum at 1320° C. for 1 hour was carried out. The resulting sintered body had a density of 8.6 g/cm$^3$ and a hardness of HPC 53.

EXAMPLE 7

A water atomized preliminary alloy powder of Fe-Co alloy containing 51% of Ni, usually so-called Permalloy, having a particle size of 32 μm was prepared. After kneading this powder with 4.0% of polyvinyl alcohol, 1.1% of glycerin and 7.5% of water, a thick hollow pipe having an outer diameter of 23.0 mm and an inner diameter of 11.0 mm was extruded. After heating the extruded product in a hydrogen stream to 700° C. at a rising rate of 200° C./hr, sintering in hydrogen was carried out at 1350° C. for 1 hour. The sintered product had a density of 7.9 g/cm$^3$, a remanent magnetic flux density of 13,500 Gauss, a magnetic permeability of 18,000, and coercive force of 1.5 oersteds.

EXAMPLE 8

Into the hollow material obtained in Example 3, a stainless wire having a diameter of 0.7 mm and corresponding to SUS 304 was inserted. At the time of insertion, a BN powder was coated in spraying state and cold drawing was conducted, while interposing an intermediate annealing at a stage of an area reduction of 15% to a diameter of 6.2 mm. After the drawing, the stainless wire was taken out and the hollow material was twisted with a lead angle of 35° to give a drill material with oil holes.

In the above Examples, various kinds of high speed tool steel, Stellite, Fe-Ni Permalloy and Fe-3Si soft magnetic material are used, but this invention is not limited thereto. Needless to say, stainless steel, general structural steel, and the like can be applied in the process of this invention.

As mentioned above, according to this invention, highly densified metallic sintered parts such as hollow, rod-like, or thin-plate-like metallic sintered parts can be produced with low cost and industrially advantageously.

What is claimed is:

1. An elongated, twisted, highly densified metallic sintered part having at least one continuous hole penetrating within the part in the direction of elongation, the part produced by the process of:

selecting, mixing and kneading a raw metallic powder having a particle size of 50 μm or less with a water-based binder composition selected to give an extrudable plastic mixture, extruding the plastic mixture to give an extruded product including the step of forming said at least one hole penetrating along the direction of said part, removing the binder composition from the extruded product with heating in vacuum or in a non-oxidizing atmosphere, and sintering the resulting product for consolidation, wherein the binder composition comprises 1.0 to 15.0% by weight of at least one water-soluble organic binder selected from the group consisting of methylcellulose, polyvinyl alcohol, hydroxypropyl methylcellulose, hydroxymethylcellulose, and polyethylene glycol; 7% by weight or less of at least one moulding auxiliary agent selected from the group consisting of hydric alcohols, ethers and esters of hydric alcohols, propylene glycol, polyethylene oxide, water-soluble acryllic resins, wax emulsions, crystalline celluloses, stearic acid emulsion microcrystalline wax, the total weight of the organic binder and the molding auxiliary agent being 1.0 to 15.0% by weight; and 4.0 to 15.0% by weight of water, all the weight percents being based on the weight of the raw metallic powder, and twisting the sintered product about the extrusion direction to a predetermined lead angle.

2. The sintered part as in claim 1 having two continuous holes.

3. A twist drill bit formed from the part of claim 1.

4. A twist drill bit formed from the part of claim 2.

5. An elongated, twisted, highly densified metallic sintered part having at least one continuous hole penetrating within the part in the direction of elongation, the part produced by the process of:

selecting, mixing and kneading a raw metallic powder having a particle size of 50 μm or less with a water-based binder composition selected to give an extrudable plastic mixture, extruding the plastic mixture to give an extruded product including the step of forming said at least one hole penetrating along the extrusion direction of said part, removing the binder composition from the extruded product with heating in vacuum or in a non-oxidizing atmosphere, and sintering the resulting product for consolidation, wherein the binder composition comprises 1.0 to 15.0% by weight of at least one water-soluble organic binder selected from the group consisting of methylcellulose, polyvinyl alcohol, hydroxypropyl, methylcellulose, hydroxymethylcellulose, and polyethylene glycol; 7% by weight or less of at least one molding auxiliary agent selected from the group consisting of hydric alcohols, ethers and esters of hydric alcohols, propylene glycol, polyethylene oxide, water-soluble acrylic resins, wax emulsions, crystalline celluloses, stearic acid emulsion, microcrystalline wax, the total weight of the organic binder and the molding auxiliary agent being 2.0 to 15.0% by weight; and 4.0 to 15.0% by weight of water, all the weight percents being based on the weight of the raw metallic powder, and twisting the sintered product about the extrusion direction to a predetermined lead angle, wherein the sintering step is followed by a step of plastic working selected from the group consisting of forging, rolling, drawing, swaging, and hot hydrostatic working, for densification to 95% or more of the true density, before said twisting step.

6. The sintered part as in claim 5 having two continuous holes.

7. A twist drill bit formed from the part of claim 5.

8. A twist drill bit formed from the part of claim 6.

9. An elongated, twisted, highly densified metallic sintered part having at least one continuous hole penetrating within the part in the direction of elongation, the part produced by the process of:

selecting, mixing, and kneading a raw metallic powder having a particle size of 50 μm or less with a water-based binder composition selected to give an extrudable plastic mixture, extruding the plastic mixture to given an extruded product including the step of forming said at least one hole penetrating along the extrusion direction of said part, removing the binder composition from the extruded product with heating in vacuum or in a non-oxidizing atmosphere, and sintering the resulting product for consolidation, wherein the binder composition comprises 1.0 to 15.0% by weight of at least one water-soluble organic binder selected from the group consisting of methylcellulose, polyalcohol, hydroxypropyl methycellulose, hydroxymethylcellulose, and polyethylene glycol; 7% by weight or less of at least one molding auxiliary agent selected from the group consisting of hydric alcohols, ethers and esters of hydric alcohols, propylene glycol, polyethylene oxide water-soluble acrylic resins, wax emulsions, crystalline celluloses, stearic acid emulsion, microcrystalline wax, the total weight of the organic binder and the molding auxiliary agent being 1.0 to 15.0% by weight; and 4.0 to 15.0% by weight of water, all the weight percents being based on the weight of the raw metallic powder, and twisting the sintered product about the extrusion direction to a predetermined lead angle, the process further comprising after the sintering step and before the twisting step, inserting a non-stick wire into said one hole, narrowing the diameter of said one hole by a metal working step selected from the group consisting of drawing and swaging, and removing the wire.

10. The sintered part as in claim 9 having two continuous holes.

11. A twist drill bit formed from the part of claim 9.

12. A twist drill bit formed from the part of claim 10.

13. An elongated, twisted, highly densified metallic sintered part having at least one continuous hole penetrating within the part in the direction of elongation, the part produced by the process of:

selecting, mixing and kneading a raw metallic powder having a particle size of 50 μm or less with a water-based binder composition selected to give an extrudable plastic mixture, extruding the plastic mixture to give an extruded product including the step of forming said at least one hole penetrating along the extrusion direction of said part, removing the binder composition from the extruded product with heating in vacuum or in a non-oxidizing atmosphere, and sintering the resulting product for consolidation, wherein the bindercomposition comprises 1.0 to 15.0% by weight of at least one water-soluble organic binder selected from the group consisting of methylcellulose, polyvinyl alcohol, hydroxypropyl methylcellulose, hydroxymethylcellulose, and polyethylene glycol; 7% by weight or less or at least one molding auxiliary agent selected from the group consisting of hydric alcohols, ethers and esters of hydric alcohols, propylene glycol, polyethylene oxide, water-soluble acrylic resins, wax emulsions, crystalline celluloses, stearic acid emulsion, microcrystalline wax, the total weight of the organic binder and the molding auxiliary agent being 1.0 to 15.0% by weight; and 4.0 to 15.0% by weight of water, all the weight percents being based on the weight of the raw metallic powder, and twisting the sintered products about the extrusion direction to a predetermined lead angle, wherein a drawing step is used after the extrusion step to reduce the hole diameter, and wherein the process further comprises after the sintering and drawing steps and before the twisting step, inserting a non-stick wire into said one hole, narrowing the diameter of said one hole by a second metal working step of drawing, and removing the wire.

14. The sintered part as in claim 13 having two continuous holes.

15. A twist drill bit formed from the part of claim 13.

16. A twist drill bit formed from the part of claim 14.

17. An elongated, twisted, highly densified sintered powdered metal part having at least one continuous hole penetrating within the part in the direction of elongation, the part having a density of greater than about 95% of true density.

18. The sintered powdered metal part as in claim 17 having a density greater than about 97% of true density.

* * * * *

UNITED STATES PATENT AND TRADEMARK OFFICE

CERTIFICATE OF CORRECTION

PATENT NO. : 4,913,737

DATED : April 3, 1990

INVENTOR(S) : HIDEKI NAKAMURA ET AL.

It is certified that error appears in the above-identified patent and that said Letters Patent is hereby corrected as shown below:

In the Abstract, line 2, change "be", second occurrence to --by--.

Claim 1, column 8, line 67, change "moulding" to --molding--.

Claim 9, column 10, line 1, change "given" to --give--.

Claim 9, column 10, lines 12-13, change "methycellulose" to --methylcellulose--.

Signed and Sealed this

Ninth Day of July, 1991

*Attest:*

HARRY F. MANBECK, JR.

*Attesting Officer*

*Commissioner of Patents and Trademarks*